US006980160B2

(12) United States Patent
Candal

(10) Patent No.: US 6,980,160 B2
(45) Date of Patent: Dec. 27, 2005

(54) ANTENNA STRUCTURE WITH INTEGRAL IMPEDANCE SWITCH MECHANISM

(75) Inventor: Alejandro Candal, Davie, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/791,237

(22) Filed: Mar. 2, 2004

(65) Prior Publication Data

US 2005/0195113 A1 Sep. 8, 2005

(51) Int. Cl.[7] ..... H01Q 1/24
(52) U.S. Cl. ..... 343/702; 343/859; 343/860
(58) Field of Search ..... 343/702, 725, 343/850, 853, 859, 860

(56) References Cited

U.S. PATENT DOCUMENTS

| | | | | |
|---|---|---|---|---|
| 5,940,040 | A * | 8/1999 | Koyanagi et al. | 343/702 |
| 5,969,682 | A * | 10/1999 | Ito et al. | 343/702 |
| 5,969,683 | A * | 10/1999 | Hayes et al. | 343/702 |
| 6,366,247 | B1 * | 4/2002 | Sawamura et al. | 343/702 |
| 6,466,173 | B1 | 10/2002 | Li | 343/702 |

* cited by examiner

*Primary Examiner*—Hoang V. Nguyen

(57) ABSTRACT

An antenna structure (142) having a retractable element (124) and a reactive antenna circuit (118). The antenna structure components conductively disconnect the reactive circuit (118) from the RF drive (138) when the retractable element (124) is extended, and conductively reconnect them when the retractable element (124) is retracted. The retractable element (124) is also conductively connected to the RF drive (138) when the retractable element (124) is extended and conductively disconnected when the retractable element (124) is retracted. The reactive circuit (118) maintains substantially similar impedance to the retractable element (124) for an RF antenna circuit when the retractable antenna (142) is in both the extended and the retracted positions.

12 Claims, 5 Drawing Sheets

ANTENNA STRUCTURE WITH INTEGRAL IMPEDANCE SWITCH MECHANISM

FIELD OF THE INVENTION

The present invention generally relates to the field of radio frequency antennas and more particularly to antenna structures with variable geometries.

BACKGROUND OF THE INVENTION

Many wireless communications devices, such as cellular telephones, pagers, remote control devices, and the like, benefit from operating with physically longer antennas. This is often in conflict with a desire to have a minimum physical package size for such devices. One technique used to accommodate these conflicting concerns is to use a retracting antenna, such as a retracting whip antenna.

Portable wireless communications devices that include retracting antennas are sometimes required to wirelessly communicate even when the antenna is retracted. An example of such operation is a cellular phone that is kept in a person's pocket with its antenna retracted but that still receives and even transmits status and other information while in the person's pocket with the antenna retracted. Moving a retractable antenna from an extended to a retracted position, and vice versa, generally causes the antenna to change its impedance characteristics. This requires a compromise to be made in impedance matching circuits that couple an RF signal to and/or from the antenna so that acceptable performance is achieved while the antenna is both extended and retracted. This compromise is a particular problem with impedance matching circuits that are used to optimize antenna operation in multiple RF bands. This compromise results in a loss of antenna efficiency when the antenna is in either position compared to the efficiency that could be achieved if impedance matching could be optimized for each position.

Therefore a need exists to overcome the problems with the prior art as discussed above.

SUMMARY OF THE INVENTION

According to an embodiment of the present invention, an antenna structure includes a first radiation element with a first element drive contact and an RF drive contact coupled to an RF signal interface. The antenna structure also has a moveable antenna element moveable between a first position and a second position, the moveable antenna element comprising a second radiation element. The moveable antenna element is configured to, while not in the second position, form a first conductive path between the RF drive contact and the first element drive contact while conductively isolating the RF drive contact from the second radiation element, thereby presenting a first impedance for the RF signal interface. The moveable antenna element is further configured to, while in the second position, conductively isolate the RF drive contact from the first element drive contact while forming a second conductive path between the RF drive contact and the second radiation element, thereby presenting a second impedance for the RF signal interface.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

DETAILED DESCRIPTION

Figure 1:
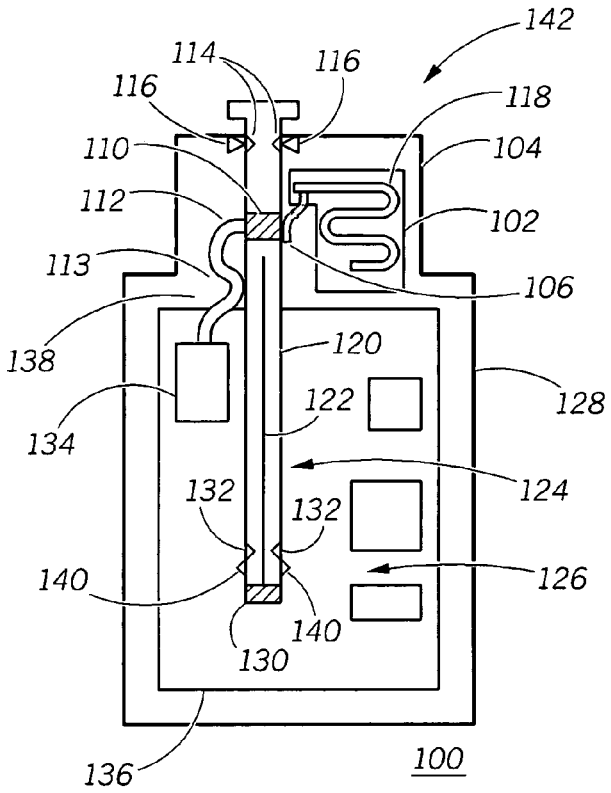
FIG. 1 is a cut-away illustration of a cellular telephone incorporating an antenna structure shown in its retracted position, according to an exemplary embodiment of the present invention.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language).

The present invention, according to an embodiment, overcomes problems with the prior art by providing an antenna structure that is composed of two parts, a retractable whip element and a stubby element. The retractable element of the exemplary embodiment is composed of a moveable nickel-titanium (NiTi) radiation element that has a plastic overmold. The stubby element incorporates a first radiation element that is a meander line circuit, a coil or other reactive circuit that is also overmolded with plastic. The antenna structure components are constructed so as to cause the meander line, coil or other reactive circuit to be conductively disconnected from the RF drive when the retractable element is extended, and to conductively reconnect the meander line or other reactive circuit to the RF drive when the retractable element is retracted. The radiation element is also conductively connected to the RF drive to the antenna when the whip is extended and conductively disconnected from the RF drive when the whip is retracted. Exemplary embodiments of the present invention provide an efficient and economically constructed switching arrangement to implement this operation.

In conventional retractable antenna designs, destructive resonances that are caused by the interaction of whip and stubby may appear in the antenna extended response, as is demonstrated by an increased RF input reflection response (usually denominated as $S_{11}$) of those antennas. This causes lower antenna efficiency if the band of interest is near the frequencies of these destructive resonances. This effect is caused at least in part by the reactive and conductive coupling of the meander line stubby antenna to the whip portion of the antenna when the whip antenna is in its extended position and both of these elements are conductively connected to the RF drive signal. In these conventional designs, these unwanted resonances can be tuned to have a frequency that is sufficiently far from the frequency band of interest so as reduce its impact on the efficiency of the antenna near the frequency band of interest. This tuning requirement, however, adds an extra variable to the antenna's design. This phenomenon has a greater impact as the frequency band of operation for the antenna increases to include several operational bands. These destructive resonances in antennas used by cellular phones have been observed to occur, for example, in frequency bands that are close to the frequency bands used by the Global Positioning System (GPS) and the General System for Mobile (GSM) radio services. Embodiments of the present invention obviate this problem since the whip portion of the antenna is disconnected from the meander line flex stubby antenna when the whip portion is in its extended position. Disconnecting the whip from the meander removes the coupling from these elements and therefore does not induce increased RF input reflection a the RF signal interface near a frequency band of interest.

Designs include a flexible circuit substrate, or a "flex circuit," to form a mechanical base for the reactive circuit meander line and RF drive contacts for that reactive element in order to maximize construction efficiency and minimize cost. The use of a flex substrate allows a single substrate to be used for the meander line circuit and as a mechanical support material for electrical contacts that are urged against mating contacts and operated directly or indirectly by the movement of a moveable antenna portion, as is described below. These embodiments further incorporate meander line or other reactive circuits that have impedance characteristics such that the RF drive to the antenna structure is substantially similar when the retractable element is in both the extended and retracted position. Such substantially similar impedances particularly result in increased bandwidth and more efficient performance for the antenna when the retractable antenna is in both its retracted and extended position.

It is to be noted that, as is well known in the RF antenna arts, antennas exhibit similar characteristics when employed in receiving and transmitting functions. The RF characteristics of antennas described herein, including but not limited to impedance as exhibited at interface, etc., are equivalent for either transmit or receive operations. It is to be further understood that an RF drive point for an antenna is able to be equally considered as an RF input or output point for that antenna. It is therefore to be understood that descriptions reciting one of transmit or receive operations for antennas within this specification apply equally to the other or both receive and transmit operations.

FIG. 1 is a cut-away view illustrating a cellular telephone 100 incorporating an antenna mechanism, according to an exemplary embodiment of the present invention. Embodiments of the present invention include any type of wireless device including, without limitation, portable radios, pagers, data communications terminals, remote controllers, wireless communicators, cell phones, and other such devices. Alternate embodiments use an antenna structure to receive, transmit, or both, in one or more RF bands. The cellular phone of the exemplary embodiment has a case 128 and an electrical circuit board 136 that includes analog and digital electronic components and interconnection circuits 126, as is known in the relevant arts.

Electrical circuit board 136 includes RF transmit and receive circuits that produce and process RF signals. These RF signals are transmitted and/or received by the antenna structure 142. The RF signals are coupled to the antenna structure 142 at an RF signal interface that includes an impedance matching network 134. Impedance matching network 134 is designed to optimize the RF performance of the antenna structure over one or more RF bands in which the cellular phone 100 operates by maximizing the amount of RF energy that is transferred to and from the antenna structure 142. The design of the impedance matching networks in the exemplary embodiments of the present invention is simplified by the operation of the antenna structure 142, which operates to provide substantially similar impedance at the RF signal interface when the antenna is in both its retracted and extended positions. The RF transmit and receive circuits, impedance matching network 134 and the antenna structure 142 form an RF circuit, such as a module, for the exemplary embodiment.

The antenna structure 142 includes a moveable antenna element 124 that is a whip antenna structure. The moveable antenna element 124 of this exemplary embodiment includes a Titanium Nickel (TiNi) radiation element 122, which is a second radiation element in this embodiment. The radiation element 122 is a conductive member of the moveable antenna element 124 that operates to radiate and receive RF energy. The radiation element 122 of this exemplary embodiment is surrounded by a substantially non-conductive plastic overmold 120. The overmold 120 of this exemplary embodiment includes top detents 114 and bottom detents 132. The top detents 114 and bottom detents 132 are physical features molded into the overmold 120 to engage yieldable pins 116 so as to retain the moveable antenna element 124 in a retracted position (as shown in FIG. 1) or the extended position, as is discussed below. The moveable antenna element 124 is held in the retracted, or a first, position when the top detents 114 engage the yieldable pins 116. The moveable antenna element 124 is held in an extended, or second, position when the moveable antenna element 124 is extended outward from the cell phone, as is discussed below, and the bottom detents 132 engage the yieldable pins 116.

The moveable antenna element 124 of this exemplary embodiment includes a conductive element 110. Conductive element 110 in the exemplary embodiment is a metal ring that is a conductive material that is secured in the moveable antenna element 124 of this embodiment. The height of the conductive element 110 is selected so as to allow engagement and effective conductive contact with adjacent RF contacts, as is described below. The conductive element 110 of this exemplary embodiment is also physically removed from the top end of the radiation element 122. This exemplary embodiment has the conductive element 110 placed approximately 3 mm above the top end of the radiation element 122. This substantially reduces the impact of the conductive element 110 on the radiation characteristics of the radiation element 122 when the radiation element 122 receives and transmits signals. The placement of the conductive element 110 of the exemplary embodiment also essentially removes the radiation element 122 from the RF circuit when the moveable antenna element 124 is retracted.

The moveable antenna element 124 further includes a radiation element contact 130 that is in conductive contact with the radiation element 122. While the moveable antenna element 124 is in the retracted position, as is illustrated in FIG. 1, the radiation element contact 130 is not in contact with other parts within the retracted antenna cellular phone 100.

The impedance matching network 134 couples an RF signal to the retractable RF antenna structure 142 through an antenna RF drive contact 138. The RF drive contact 138 of this exemplary embodiment includes a first contact 112 and a second contact 113. The first contact 112 and the second contact 113 are constructed so as to be urged to physically engage the moveable antenna element 124 while allowing the moveable antenna element 124 to move from the retracted position, as shown, to the extended position. When the moveable antenna element 124 is in the retracted position, as is shown in FIG. 1, the first contact 112 is in conductive contact with the conductive element 110 of the moveable antenna element 124.

The conductive element 110 of this exemplary embodiment is also in conductive contact with a first element drive contact, which is a meander line drive contact 106 in this embodiment. The meander line drive contact 106 is a first element drive contact that is urged into contact with the moveable antenna element 124 and is also in conductive contact with a meander line element 118 that is located on the same flexible printed circuit in the exemplary embodiment. The meander line circuit 118 of the exemplary embodiment operates to implement at least part of a "stubby," or reduced profile, antenna for operation while the moveable antenna element 124 is retracted. The meander line circuit of this exemplary embodiment also influences the drive impedance of the moveable antenna structure 142, as is driven by the impedance matching network 134 while the moveable antenna element 124 is retracted.

It is to be noted that the second contact 113 is not in conductive contact with any conductive portion of the moveable antenna element 124. There is also no conductive contact between the radiation element 122 and the RF drive contact 138. There is also no appreciable inductive coupling of the RF drive signal to the radiation element 122. This results in the radiation element 122 not having an appreciable influence upon the drive impedance of the moveable antenna structure 142 while the moveable antenna element is in the retracted position.

Figure 2:
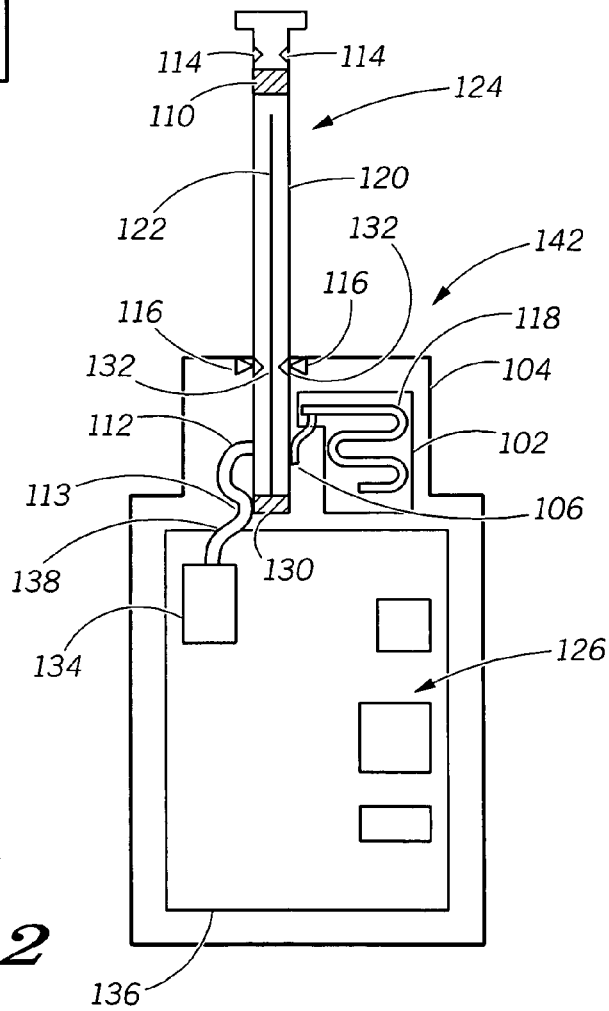
FIG. 2 is a cut-away illustration of a cellular telephone incorporating an antenna structure shown in its extended position, according to an exemplary embodiment of the present invention.

FIG. 2 is a cut-away view illustrating an extended antenna cellular telephone 200 incorporating an antenna structure, according to an exemplary embodiment of the present invention. The extended antenna cellular telephone 200 is the same device as illustrated for the retracted antenna cellular phone 100, except that the moveable antenna element 124 has been moved to the extended, or second, position. In this configuration, bottom detents 132 on the moveable antenna element 124 engage the yieldable pins 116 so as to retain the movable antenna element 124 in the extended position.

When the moveable antenna element 124 is in the extended position, as is illustrated in FIG. 2, the radiation element contact 130 engages the second contact 113 of the RF drive contact 138. This creates a second conductive path between the RF drive contact 138 and the radiation element 122, thereby placing the radiation element into the RF circuit when the moveable antenna element 124 is in the extended position. The impedance of the movable antenna structure 142 is therefore dependent upon the impedance of the radiation element 122.

It is to be further noted that when the moveable antenna element 124 is in the extended position, the first contact 112 of the RF drive contact 138 and the meander line drive contact 106 are both urged against the substantially non-conductive overmold 120 of the moveable antenna element 124. This provides conductive isolation between the RF drive contact 138 and the meander line element 118, thereby removing the meander line element 118 from the RF circuit when the moveable antenna element 124 is in the extended position.

As described above, the impedance of the moveable antenna structure 142 is influenced by different components depending upon the position of the movable antenna element 124. When the moveable antenna element 124 is in the retracted position, the meander line element 118 is part of the RF circuit for the moveable antenna structure 142 and the radiation element 122 is not part of that RF circuit. When the moveable antenna structure 124 is moved to its extended position, the radiation element 122 is part of the RF circuit of the moveable antenna structure 142 and the meander line element 118 is not. The designs of the exemplary embodiments of the present invention, as described herein, illustrate exemplary switching techniques that are used to automatically create these different RF circuits based upon the position of the moveable antenna element. These different RF circuits, based upon the position of the moveable antenna element 124, are created in the above described embodiment by the operation of physical contact arrangements between the RF drive contact 138 and either the radiation element contact 130 or the meander line contact 106 through the conductive element 110, respectively.

The meander line 118 of the exemplary embodiments is designed so as to cause the moveable antenna structure 142 to exhibit, in the one or more bands that the cellular telephone operates, an RF impedance exhibited at the RF drive connector 138 that is substantially similar when the moveable antenna element 124 is in either its extended position or its retracted position. Maintaining this similar impedance advantageously optimizes antenna efficiency and RF energy transfer between the moveable antenna structure 142 and the matching network 134 when the moveable antenna element 124 is in either position.

Figure 3:
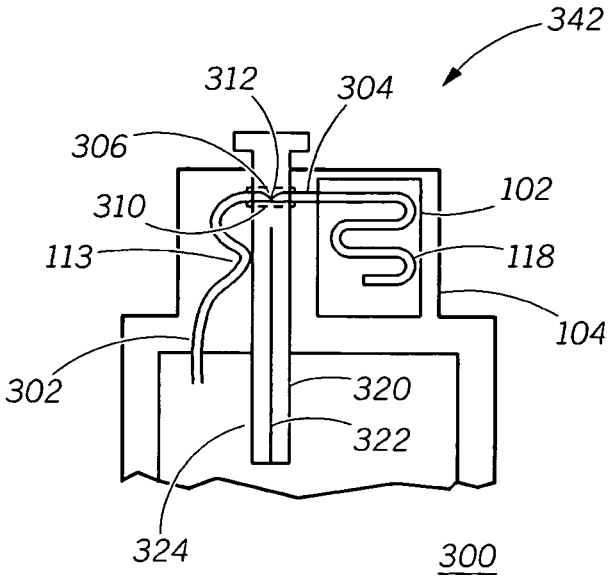
FIG. 3 is a cut-away illustration of a cellular telephone showing a detail of the RF drive connections of an antenna structure shown in its retracted position, according to an alternative exemplary embodiment of the present invention.

FIG. 3 is a cut-away view illustrating an alternative moveable antenna structure of a retracted antenna cellular telephone 300, according to an alternative exemplary embodiment of the present invention. The alternative moveable antenna structure 342 of this embodiment of the present invention incorporates a similar meander line element 118 and Flex substrate 102 as discussed above.

The alternative moveable antenna structure 342 forms a first conductive path between an alternative first contact 306 of an alternative RF drive contact 302 and an alternative meander line contact 304. This first conductive path is formed by allowing a direct physical connection between these two contacts. This direct physical connection is formed by a physical feature on an alternative moveable antenna element 324. In this exemplary embodiment, the physical feature is a through-hole 310 that extends through the substantially non-conductive overmold 320 of the alternative moveable antenna. Further alternative embodiments of the present invention use various physical features, such as detents, protrusions, or other features, to either engage or disengage contacts between conductive conductors.

When the alternative moveable antenna element 324 is positioned in its retracted position, through-hole 310 accepts the first contact 306 of the alternative RF contact 302 and the alternative meander line contact 304, thereby forming the first conductive path between these two contacts. It is also to be noted that the radiation element 322 of the moveable antenna element is physically removed from the first contact 306 and the alternative meander line contact 304 while the alternative moveable antenna element 324 is in its retracted position, thereby conductively isolating the radiation element 322 from the first conductive path.

Figure 4:
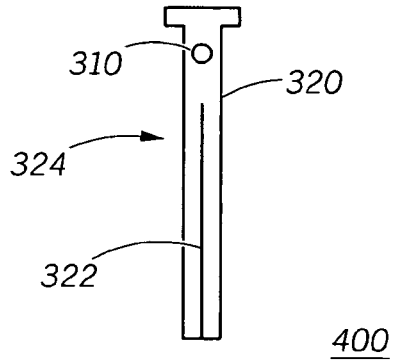
FIG. 4 illustrates a side view of an antenna structure element incorporated into the antenna structure according to the alternative exemplary embodiment illustrated in FIG. 3.

FIG. 4 is a planar side view 400 illustrating the retractable antenna element incorporated into the antenna structure according to the alternative exemplary embodiment of the present invention. Through-hole 310 is shown as a cylindrical opening through the substantially non-conductive plastic overmold 320 of the alternative moveable antenna element 324. The radiation element 322 is also shown as physically removed from the through-hole 310.

As the alternative moveable antenna element 322 is extended, the first contact 306 of the alternative RF contact 302 and the alternative meander line contact 304 both withdraw from the through-hole 310 and thereby become conductively isolated from each other.

Figure 5:
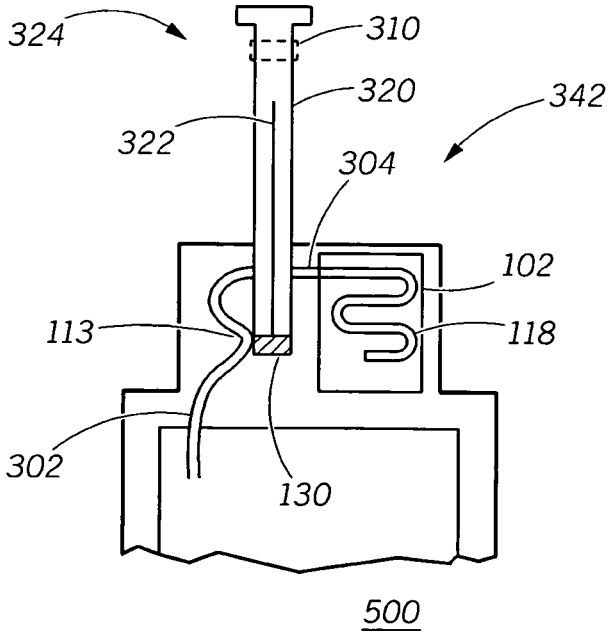
FIG. 5 is a cut-away illustration of a cellular telephone showing a detail of the RF drive connections of an antenna structure shown in its extended position, according to an alternative exemplary embodiment of the present invention.

FIG. 5 is a cut-away view illustrating the alternative moveable antenna structure of an extracted antenna cellular telephone 500, according to an alternative exemplary embodiment of the present invention. The alternative moveable antenna structure 342 is similar to that described above but with the moveable antenna element 324 placed in its extended, or second, position. When the alternative moveable antenna element 324 is in this position, the first contact 306 of the alternative RF drive contact 302 and the alternative meander line contact 304 are in physical contact with the substantially non-conductive overmold 320, and are thereby conductively isolated. The second contact 113 of the alternative RF drive contact 302, however, is in conductive contact with the radiation element contact 130 of the alternative moveable antenna element 324. The radiation element contact 130 is constructed to be in conductive contact with the radiation element 322 of the alternative moveable antenna element 324. When the alternative moveable antenna element 324 is in its extended position, the alternative radiation element 322 is part of the RF circuit of the alternative moveable antenna structure 342 and the meander line element 118 is not.

Figure 6:
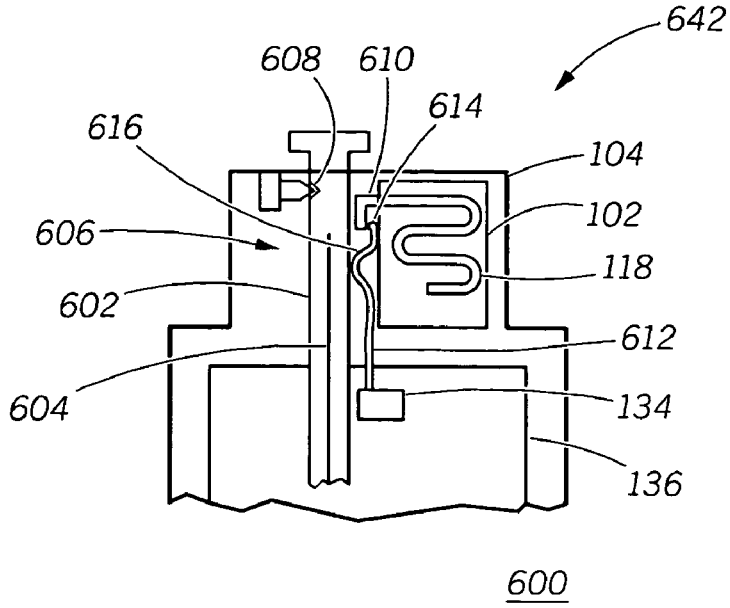
FIG. 6 is a cut away illustration of a retracted antenna cellular phone according to a second alternative exemplary embodiment of the present invention.

FIG. 6 is a cut-away view illustrating another alternative moveable antenna structure 600 of a retracted antenna cellular telephone, according to a second alternative exemplary embodiment of the present invention. The alternative moveable antenna structure 642 of this second alternative embodiment of the present invention incorporates a similar meander line element 118 and Flex substrate 102 as discussed above. The alternative meander line drive contact 610 and the alternative first contact 614 of the alternative RF drive contact 612 are constructed to remain in physical and conductive contact while the alternative moveable antenna element 606 is in its retracted position, as is shown. Yieldable pin 116 engages a top detent 608 to retain the alternative movable antenna element in its retracted position. As is noted by the design illustrated for the alternate movable antenna structure, the alternative first contact 614 and alternative meander line drive contact 610 remain in physical and conductive contact when the alternative moveable antenna element 606 is moved from its retracted position and is part way to its extended position.

Figure 7:
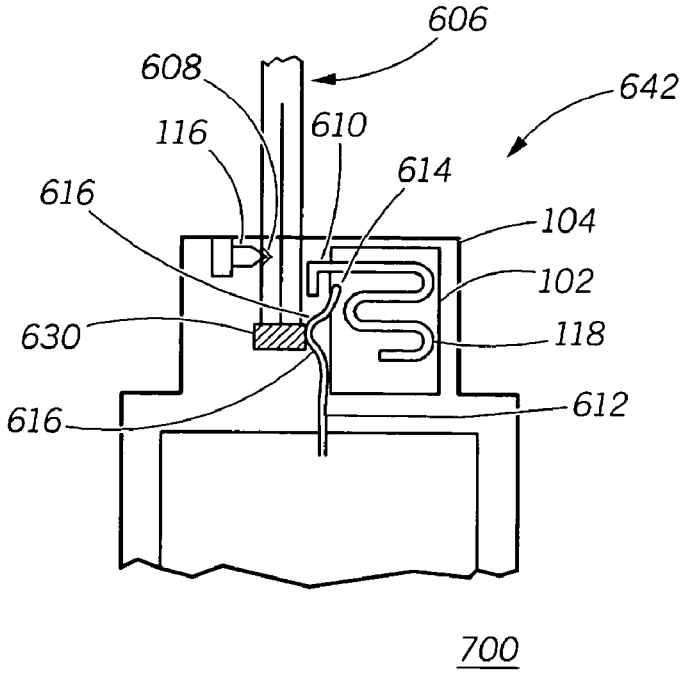
FIG. 7 is a cut away illustration of an extended antenna cellular phone according to a second alternative exemplary embodiment of the present invention.

FIG. 7 is a cut-away view illustrating the other alternative moveable antenna structure of an extracted antenna cellular telephone 700, according to a second alternative exemplary embodiment of the present invention. The extracted antenna cellular phone 700 illustrates the alternative moveable antenna element in an extended position. In this extended position, the radiation element contact 630 engages a second contact 616 of the alternative RF drive contact 612 and urges it away from the alternative meander line drive contact 610. In this exemplary embodiment, the radiation element contact 630 forms a feature that causes the first contact 614 to disengage from the alternative meander line contact 610.

Figure 8:
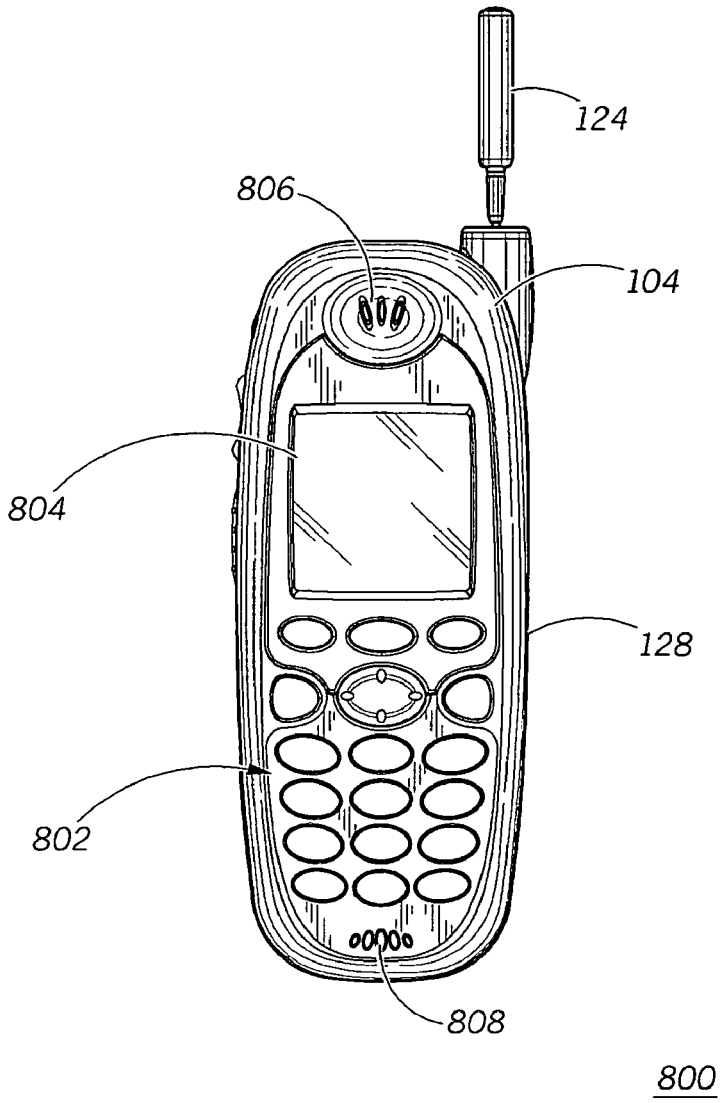
FIG. 8 is a front view of a cellular phone according to an exemplary embodiment of the present invention.

FIG. 8 illustrates an exemplary cellular phone 800, in accordance with an exemplary embodiment of the present invention. The cellular phone 800 of this exemplary embodiment includes a microphone 808, an earpiece/speaker 806, keypad 802, display 804, and other electrical and human-machine interface facilities (not shown) to allow the input and output of audio and/or video signals as well as data input and output, as are known by practitioners in the relevant arts. These input and output data, audio and/or video signals are processed by a baseband processing portion to properly condition and format signals as required to properly interface between the receiver, transmitter and the electrical and human-machine interface facilities.

The exemplary cellular phone 800 further includes a receiver circuit that is used to wirelessly receive signals that are transmitted from remote stations as well as transmitter circuits that are used to wirelessly transmit signals to remote stations. The exemplary cell phone 800 of FIG. 8 benefits from the advantages of the new and novel retractable antenna structure with integral switch mechanism according to the present invention.

Figure 9:
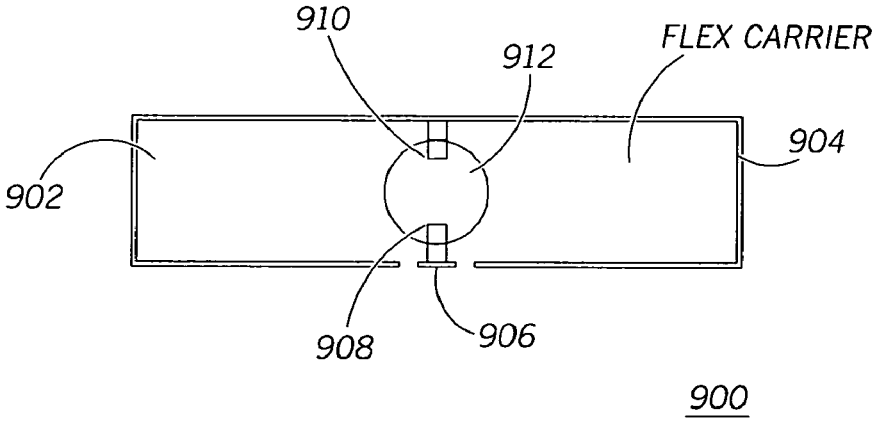
FIG. 9 is a meander line circuit antenna top view of a meander line element according to an exemplary embodiment of the present invention.

FIG. 9 illustrates a meander line circuit antenna top view 900 of a meander line element according to an exemplary embodiment of the present invention. The meander line circuit antenna top view 900 illustrates a meander line circuit antenna 904 that is more fully described below. The meander line circuit antenna top view 900 further shows a flex carrier 902 that provides physical support for the meander line circuit antenna. Flex carrier 902 further includes a cylindrical passage 912 that allows a whip antenna, such as moveable antenna element 124, to be inserted and moved between an extended and retracted position. An RF drive input 906 is shown and connected to a first contact 908. Second contact 910 is also shown. A movable antenna element 124 that includes a conductive element such as the conductive element 110 shown for the moveable antenna element 124 is able to be inserted into the cylindrical passage 912 and when properly positioned, a first conductive path is formed between the first contact 908 and the second contact 910. Second contact 910 is in electrically conductive contact with meander line circuit antenna 904.

Figure 10:
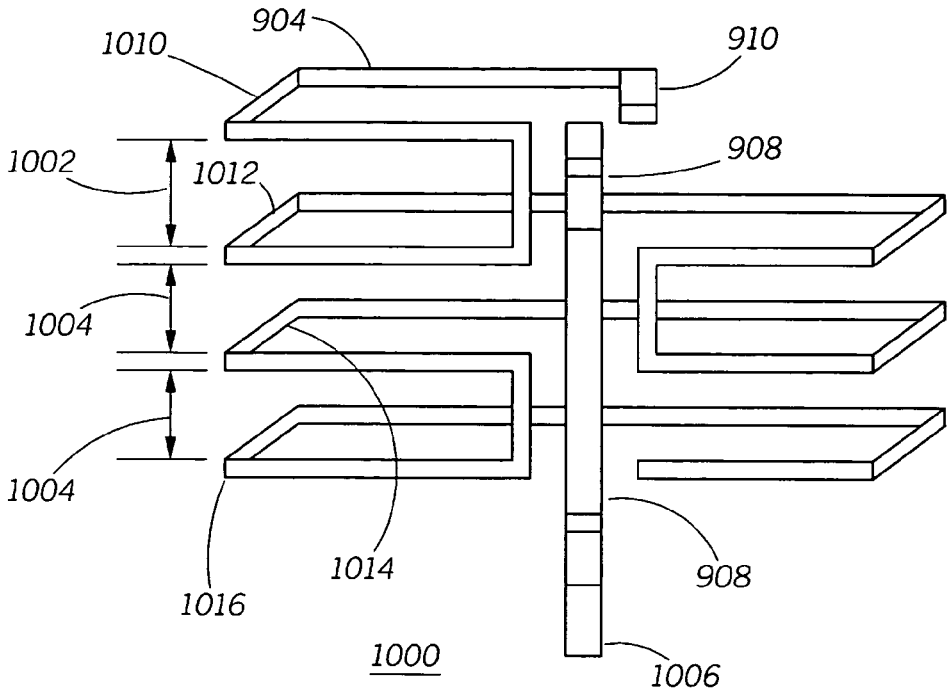
FIG. 10 is a side view of a meander line circuit antenna that corresponds to the meander line circuit antenna top view illustrated in FIG. 9.

FIG. 10 illustrates a meander line circuit antenna side view 1000 that corresponds to the meander line circuit antenna top view 900. In order to enhance clarity and understandability, the meander line circuit antenna side view

1000 does not show the flex carrier 902. It is to be understood that the flex carrier 902 is present in this meander line circuit antenna structure. The meander line circuit antenna side view 1000 shows the RF drive input 906 which has a spring contact 1006 to form an electrical contact with a circuit board, such as circuit board 136, used by a wireless device incorporating this meander line circuit antenna.

The first contact 908 and second contact 910 are shown as being located opposite each other and at the same vertical location. This facilitates forming the first conductive circuit between these two contacts when a conductive element is placed between them. The RF drive input 906 is shown as in electrical contact with the first contact 908 and the second contact 910 is in electrical contact with the meander line antenna circuit 904.

Meander line antenna circuit 904 is shown to progress in a downwardly meandering spiral. Meander line antenna circuit 904 is shown to have a first pitch 1002 between a top run 1010 and a second run 1012. The meander line antenna circuit 904 is further shown to have a second pitch 1004 between the second run 1012 and third run 1014 as well as between the third run 1014 and a fourth run 1016.

The first pitch 1002 and the second pitch 1004 are different gaps between traces of the meander line circuit antenna 904. These different pitches between different runs of the meander line antenna increase the antenna's bandwidth and provide additional bands. In addition to the flex carrier 902, a plastic over-mold (not shown) covers the meander line flex antenna circuit and the flex carrier in order to enhance ruggedness and improve aesthetics.

Figure 11:
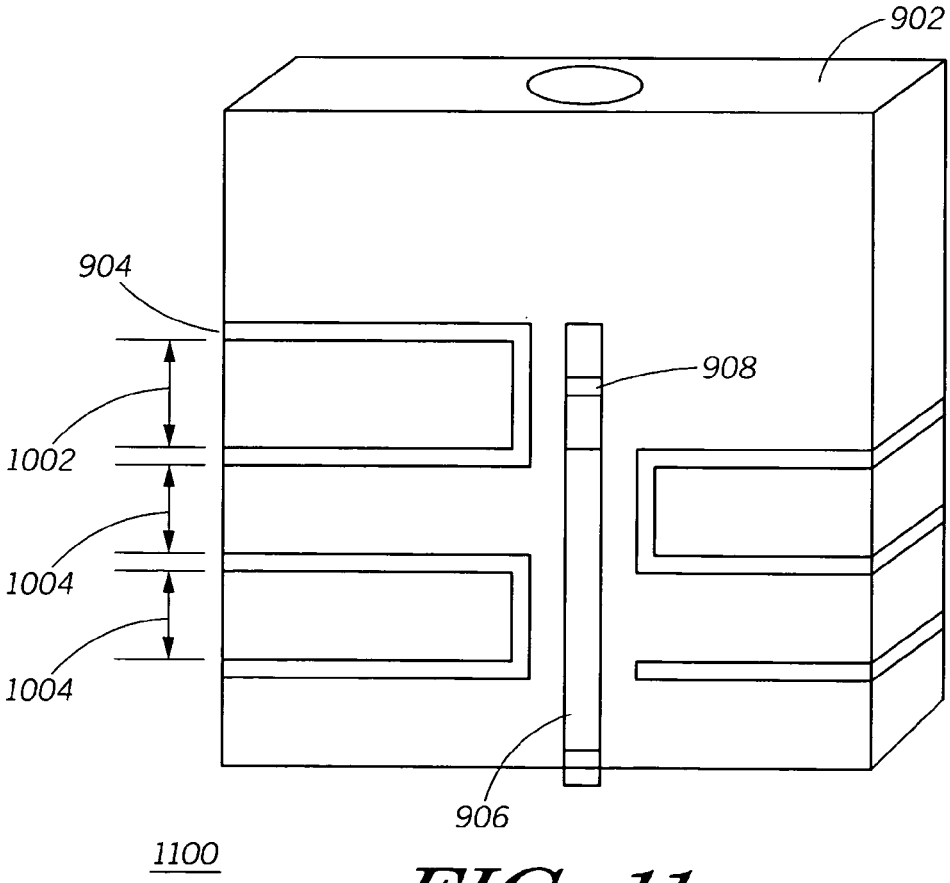
FIG. 11 is a side view of a meander line circuit antenna with flex carrier.

FIG. 11 illustrates a side view of a meander line circuit antenna with flex carrier 1100. This illustration is similar to the meander line circuit antenna side view 1000 but includes the flex carrier 902. This illustration shows how the flex carrier 902 extends above the top of the meander line circuit antenna 904.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

What is claimed is:

1. An antenna structure, comprising:

a first radiation element with a first element drive contact;

an RF drive contact coupled to an RF signal interface; and a moveable antenna element moveable between a first position and a second position, the moveable antenna element comprising a second radiation element, the moveable antenna element configured to:

while in the first position, form a first conductive path between the RF drive contact and the first element drive contact while conductively isolating the RF drive contact from the second radiation element, thereby presenting a first impedance for the RF signal interface, and while in the second position, conductively isolating the RF drive contact from the first element drive contact while forming a second conductive path between the RF drive contact and the second radiation element, thereby presenting a second impedance for the RF signal interface;

wherein the RF drive contact comprises a first contact and a second contact, the first contact forming part of the first conductive path when the moveable antenna element is in the first position and the second contact forming part of the second conductive path when the moveable antenna element is in the second position.

2. The antenna structure of claim 1, wherein the second radiation element is physically removed from the first conductive path while the moveable antenna element is in the first position.

3. The antenna structure of claim 1, wherein the first impedance is substantially similar to the second impedance.

4. The antenna structure of claim 1, further comprising an impedance matching network for coupling between the RF signal interface and the RF drive contact.

5. The antenna structure of claim 1, wherein the first conductive path is formed only in the first position.

6. The antenna structure of claim 1, further comprising an RF drive connection or the meander line drive connection, wherein the RF drive connection or the meander lin drive connection are formed on a flexible printed circuit.

7. The antenna structure of claim 1, wherein, while in the second position, coupling between the first radiation element and the moveable antenna element does not induce increased RF input reflection at the RF signal interface near a frequency of interest.

8. The antenna structure of claim 1, wherein the moveable antenna element comprises a conductive element that forms part of the first conductive path when the moveable antenna element is in the first position, wherein the conductive element conductively engages the first contact and the first element drive contact.

9. The antenna structure of claim 1, wherein the moveable antenna element comprises a feature to cause the first contact to one of conductively engage and conductively disengage the first element drive contact.

10. The antenna structure of claim 1, wherein the moveable antenna element comprises a second radiation element contact that is conductively connected to the second radiation element and engages the second contact when the movable antenna element is in the second position.

11. A wireless communication circuit, comprising:

a receiver circuit for wirelessly receiving transmitted signals or a transmitter circuit for wirelessly transmitting signals; and an antenna, communicatively coupled with the a receiver circuit or the transmitter circuit, the antenna comprising:

a first radiation element with a first element drive contact;

an RF drive contact coupled to an RF signal interface; and a moveable antenna element moveable between a first position and a second position, the moveable antenna element comprising a second radiation element, the moveable antenna element configured to:

while in the first position, form a first conductive path between the RF drive contact and the first element drive contact while conductively isolating the RF drive contact from the second radiation element, thereby presenting a first impedance for the RF signal interface, and while in the second position, conductively isolating the RF drive contact from the first element drive contact while forming a second conductive path between the RF drive contact and the second radiation element, thereby presenting a second impedance for the RF signal interface;

wherein the RF drive contact comprises a first contact and a second contact, the first contact forming part of the first conductive path when the moveable antenna element is in the first position and the second contact forming part of the second conductive path when the moveable antenna element is in the second position.

12. A wireless device, comprising:

a receiver for wirelessly receiving transmitted signals or a transmitter for wirelessly transmitting signals;

a baseband processing portion, communicatively coupled to the receiver or transmitter, for processing data, voice, image or video signals in order to interface with the receiver or the transmitter;

at least one antenna, electrically coupled to the receiver or transmitter, the at least one antenna comprising:

a first radiation element with a first element drive contact;

an RF drive contact coupled to an RF signal interface; and a moveable antenna element moveable between a first position and a second position, the moveable antenna element comprising a second radiation element, the moveable antenna element configured to:

while in the first position, form a first conductive path between the RF drive contact and the first element drive contact while conductively isolating the RF drive contact from the second radiation element, thereby presenting a first impedance for the RF signal interface, and while in the second position, conductively isolating the RF drive contact from the first element drive contact while forming a second conductive path between the RF drive contact and the second radiation element, thereby presenting a second impedance for the RF signal interface;

wherein the RF drive contact comprises a first contact and a second contact, the first contact forming part of the first conductive oath when the moveable antenna element is in the first position and the second contact forming part of the second conductive path when the moveable antenna element is in the second position.

* * * * *